US010015587B2

(12) United States Patent
Akino

(10) Patent No.: US 10,015,587 B2
(45) Date of Patent: Jul. 3, 2018

(54) DYNAMIC MICROPHONE

(71) Applicant: Hiroshi Akino, Kanagawa (JP)

(72) Inventor: Hiroshi Akino, Kanagawa (JP)

(73) Assignee: KABUSHIKI KAISHA AUDIO TECHNICA, Tokyo (JP)

( * ) Notice: Subject to any disclaimer, the term of this patent is extended or adjusted under 35 U.S.C. 154(b) by 0 days.

(21) Appl. No.: 15/379,564

(22) Filed: Dec. 15, 2016

(65) Prior Publication Data

US 2017/0180849 A1 Jun. 22, 2017

(30) Foreign Application Priority Data

Dec. 16, 2015 (JP) ..... 2015-245407

(51) Int. Cl.

| | |
|---|---|
| ***H04R 25/00*** | (2006.01) |
| ***H04R 1/32*** | (2006.01) |
| ***H04R 9/08*** | (2006.01) |
| ***H04R 7/12*** | (2006.01) |
| ***H04R 1/22*** | (2006.01) |

(52) U.S. Cl.

CPC ..... *H04R 1/326* (2013.01); *H04R 1/222* (2013.01); *H04R 7/127* (2013.01); *H04R 9/08* (2013.01)

(58) Field of Classification Search

CPC . H04R 19/04; H04R 9/08; H04R 1/08; H04R 1/04; H04R 1/083; H04R 1/086; H04R 1/06; H04R 2420/07; H04R 1/222

USPC ..... 381/177, 355–359

See application file for complete search history.

(56) References Cited

U.S. PATENT DOCUMENTS

2012/0140972 A1* 6/2012 Akino ..... H04R 3/04 381/356
2013/0070941 A1* 3/2013 Akino ..... H04R 9/025 381/122
2014/0355808 A1* 12/2014 Akino ..... H04R 1/2869 381/356

FOREIGN PATENT DOCUMENTS

| | | | |
|---|---|---|---|
| JP | 11-252675 | | 9/1999 |
| JP | 2009071752 A | * | 4/2009 |
| JP | 2015-12435 | | 1/2015 |
| JP | 2015-15613 | | 1/2015 |

OTHER PUBLICATIONS

A. Mizoguchi, "Design Conditions of the Damped Pipe for the Directional Ribbon Microphone", Journal of Acoustical Society of Japan, Feb. 26, 1962, vol. 18, No. 5, pp. 275-285.

* cited by examiner

*Primary Examiner* — Matthew Eason
*Assistant Examiner* — Julie X Dang
(74) *Attorney, Agent, or Firm* — Whitham, Curtis & Cook

(57) ABSTRACT

A dynamic microphone that enables taking a long propagation path of a sound wave on a back side of a diaphragm, and by which unidirectivity can be obtained even at a low frequency. The dynamic microphone includes: a dynamic microphone unit; and an air chamber provided on a back side of a diaphragm of the dynamic microphone unit, wherein the air chamber is folded back to make a propagation path of a sound wave on the back side of the diaphragm long, a plurality of acoustic resistors is arranged in the air chamber at intervals to each other in a direction of the propagation path of a sound wave, and acoustic resistance values of the plurality of acoustic resistors become higher as the propagation path of a sound wave goes away from the diaphragm.

10 Claims, 2 Drawing Sheets

DYNAMIC MICROPHONE

BACKGROUND

Technical Field

The present invention relates to a dynamic microphone.

Related Art

To produce an omni-directional component in a dynamic microphone, it is necessary to secure an air chamber having a sufficient length as a propagation path of a sound wave on a back side of a diaphragm. For example, a dynamic microphone used for a wireless microphone requires a space for mounting a transmitter, and thus it is difficult to secure the air chamber having a sufficient length. Therefore, among the dynamic microphones used for a wireless microphone and the like, it is difficult to obtain unidirectivity in a low frequency band.

The reason why the air chamber having a sufficient length as a passage of the sound wave is necessary on the back side of the diaphragm will be further described. Now, if there is a wall that partitions the space behind the diaphragm, in proximity to the back of the diaphragm, the air moved by vibration of the diaphragm is immediately bounced back by the wall and limits the vibration of the diaphragm, and vibration faithful to the sound wave is impeded. That is, it is in a high reactance state. Especially, an influence of the reactance is profound in a low frequency band. Therefore, to obtain the omni-directional component up to the low frequency band, it is necessary to make the path where the sound wave passes long on the back side of the diaphragm.

As a document that describes the above theory, there is "Design conditions of the damped pipe for the directional ribbon microphone", Journal of Acoustical Society of Japan, Volume 18, No. 5 (1962). The document describes that, regarding a damping element of a directional ribbon microphone, a long and narrow acoustic tube is widely used because ribbon microphones have small mechanical impedance of vibration system. Further, the document describes that the length of the acoustic tube can be made short by making acoustic resistance of the acoustic tube higher going away from the position of the diaphragm.

There are JP 11-252675 A, JP 2015-12435 A, and JP 2015-15613 A, as patent documents related to the present invention, which is described in detail below.

SUMMARY

An objective of the present invention is to obtain a dynamic microphone that enables taking a long propagation path of a sound wave on a back side of a diaphragm, and by which unidirectivity can be obtained even at a low frequency.

The present invention has a main characteristic in which a dynamic microphone includes:

a dynamic microphone unit; and an air chamber provided on a back side of a diaphragm of the dynamic microphone unit, wherein the air chamber is folded back to make a propagation path of a sound wave on the back side of the diaphragm long, a plurality of acoustic resistors is arranged in the air chamber at intervals to each other in a direction of the propagation path of a sound wave, and acoustic resistance values of the plurality of acoustic resistors become higher as the propagation path of a sound wave goes away from the diaphragm.

According to the present invention, the dynamic microphone that enables taking a long propagation path of a sound wave by folding back the air chamber on the back side of the diaphragm, and by which unidirectivity can be obtained even at a low frequency.

DETAILED DESCRIPTION

Figure 1:
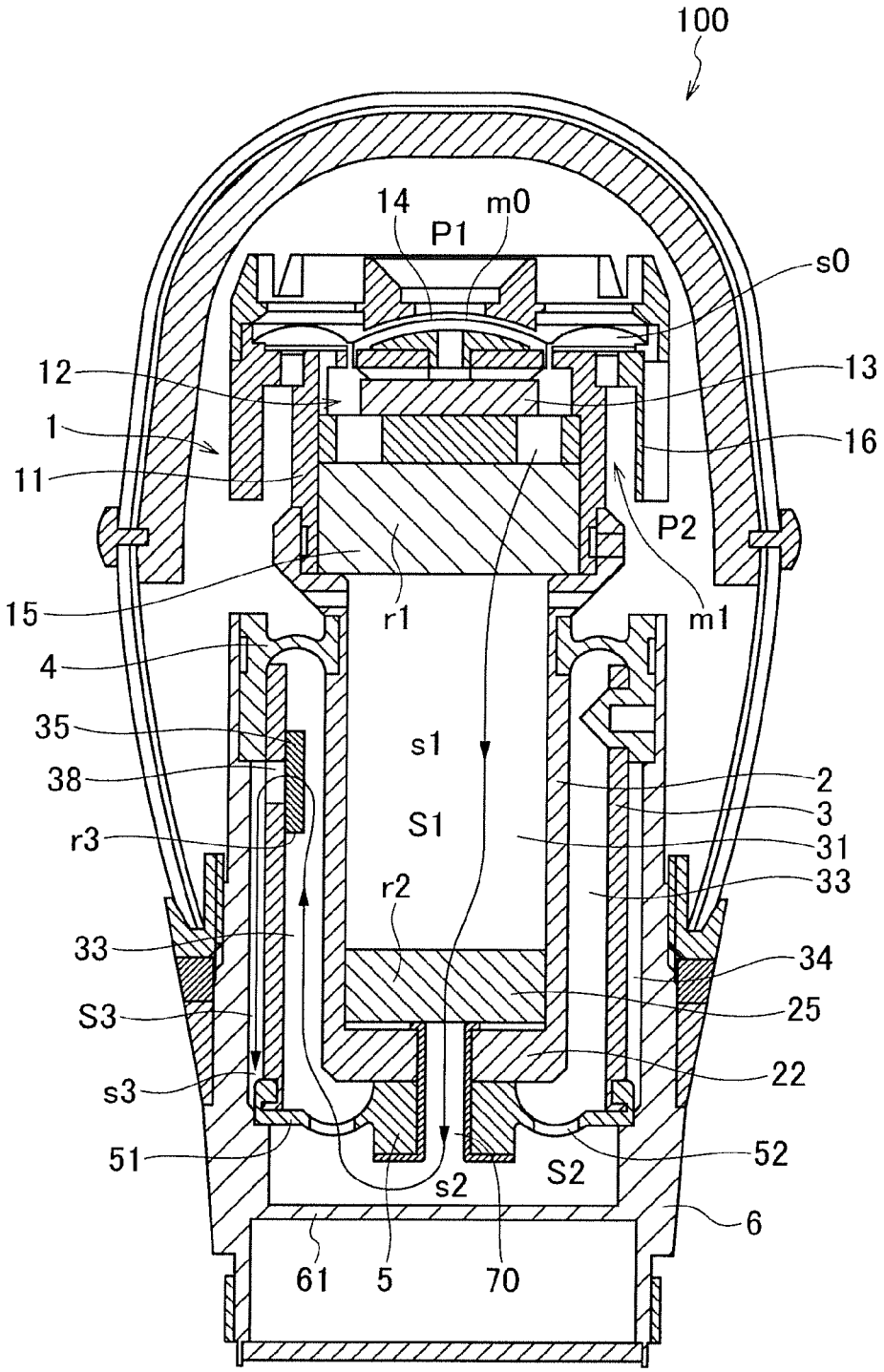
FIG. 1 is a vertical sectional view illustrating an embodiment of a dynamic microphone according to the present invention.

Hereinafter, an embodiment of a dynamic microphone according to the present invention will be described with reference to the drawings.

[Embodiment]

A dynamic microphone 100 illustrated in FIG. 1 includes, as is known, a dynamic microphone unit 1 (hereinafter, referred to as "unit 1") including a magnetic circuit 12, a diaphragm 14, a unit case 16, and the like. The magnetic circuit 12 is mainly formed of a magnet 13, and a yoke board, an outer yoke 11, a pole piece, and the like.

The diaphragm 14 includes a main dome, and a sub-dome that continues with an outer periphery of the main dome and surrounds the outer periphery, and an outer peripheral edge portion of the sub-dome is fixed to the unit case 16. An end of a voice coil is fixed along a boundary between the main dome and the sub-dome of the diaphragm 14. The voice coil exists in a magnetic gap formed by the magnetic circuit 12. When the diaphragm 14 vibrates upon receiving a sound wave, the voice coil also vibrates together with the diaphragm 14, and an audio signal corresponding to the sound wave is output from the voice coil.

In FIG. 1, a lower-end outer peripheral portion of the outer yoke 11 is fit into an upper end portion of the unit support 2, so that the unit 1 is supported by the unit support 2. The outer yoke 11 and the unit support 2 have cylindrical shapes. The magnet 13, the yoke board, and the pole piece that configure the magnetic circuit 12 together with the outer yoke 11 are incorporated in an upper half portion of an interior of the outer yoke 11. A first acoustic resistor 15 is incorporated in a lower half portion of the interior of the outer yoke 11.

A front acoustic terminal that provides a sound pressure P1 to a front side of the diaphragm 14 exists in front of the diaphragm 14. A rear acoustic terminal that provides a sound pressure P2 to the back side of the diaphragm 14 exists between an outer periphery of the outer yoke 11 and an inner periphery of the unit case 16. The acoustic terminal refers to a position of air that effectively provides a sound pressure to a microphone unit.

The magnetic circuit 12 exists on the back side of the diaphragm 14, and an appropriate hole is provided in the magnetic circuit 12 to allow a back-side space of the diaphragm 14 to communicate with an air chamber described below. When the diaphragm 14 vibrates upon receiving a sound wave, the sound wave is propagated from the back side of the diaphragm 14. The hole of the magnetic circuit 12 is a propagation path of the sound wave, and the first acoustic resistor 15 exists in the propagation path of the sound wave.

An interior of the unit support 2 has a hollow cylindrical shape and is a relatively large space, and this space serves as a first air chamber 31 that forms a part of the propagation path of the sound wave having passed through the first acoustic resistor 15. At least a part of the internal space of the unit support 2 may configure the first air chamber 31. A second acoustic resistor 25 is incorporated in a lower end of the interior of the unit support 2. A hole with a small diameter is formed in a bottom plate 22 of the unit support 2, and this hole configures a communication path 70 together with a hole of a second suspension 5 described below. The communication path 70 allows the first air chamber 31 and a second air chamber 33 described below to communicate with each other.

An upper-end outer periphery of the unit support 2 is surrounded by a first suspension 4, and an outer periphery of the first suspension 4 is joined to a microphone case 6. Therefore, the upper end portion of the unit support 2 is joined to the microphone case 6 having a cylindrical shape through the first suspension 4. A base portion of the second suspension 5 is fixed to a lower end of the unit support 2, and an outer peripheral edge portion of an elastic deformation portion 51 protruding in a flange manner in an outer peripheral direction from the base portion of the second suspension 5 is joined to the microphone case 6. Therefore, a lower end portion of the unit support 2 is joined to the microphone case 6 having a cylindrical shape through the second suspension 5.

An opening 52 that configures the communication path 70 together with the hole of the unit support 2 is formed in the base portion of the second suspension 5.

The microphone case 6 includes a bottom plate 61 that blocks a lower end of an internal space of the microphone case 6. An intermediate support 3 is provided between the unit support 2 and the microphone case 6 at intervals from both of the unit support 2 and the microphone case 6. Both end portions of the intermediate support 3 in a central axis line direction are joined to the microphone case 6. The unit support 2, the intermediate support 3, and the microphone case 6 have cylindrical shapes, and are coaxially arranged sharing the central axis line. Cylindrical spaces are respectively formed between the unit support 2 and the intermediate support 3, and between the intermediate support 3 and the microphone case 6. The space between the unit support 2 and the intermediate support 3 is larger than the space between the intermediate support 3 and the microphone case 6.

The space between the unit support 2 and the intermediate support 3 communicates with the communication path 70 through the opening 52 formed in the elastic deformation portion 51 of the second suspension 5. A space from the communication path 70 to the space between the unit support 2 and the intermediate support 3 is the second air chamber 33. The space between the intermediate support 3 and the microphone case 6 is a third air chamber 34.

The sound wave on the back side of the diaphragm 14 passes through the first acoustic resistor 15, is propagated in the first air chamber 31 downward in FIG. 1, passes through the second acoustic resistor 25, is folded back after passing through the communication path 70, and is led to the second air chamber 33 through the opening 52. The propagation path of the sound wave is formed such that the sound wave is propagated in the second air chamber 33 upward in FIG. 1, further passes through the third acoustic resistor 35 and a hole 38 formed near an upper end of the intermediate support 3 and is folded back, and is led to the third air chamber 34. The hole 38 of the intermediate support 3 is blocked with a third acoustic resistor 35. A lower end of the third air chamber 34 in FIG. 1, that is, a tip end of the propagation path of the sound wave is closed.

As described above, the dynamic microphone 100 according to the embodiment includes the unit 1, and an air chamber serving as the propagation path of the sound wave on the back side of the diaphragm 14 of the unit 1. The air chamber includes, in a direction of the propagation path of the sound wave, the first air chamber 31, the second air chamber 33, and the third air chamber 34, in this order. To make the propagation path of the sound wave long, the second air chamber 33 is folded back with respect to the first air chamber 31, and the third air chamber 34 is folded back with respect to the second air chamber 33 (i.e., by configuring the air chambers folded back as described the length of the propagation path of the sound wave is increased compared to a configuration without the air chambers folded back (the propagation path is made "longer").

There are the first acoustic resistor 15 at an inlet of the first air chamber 31, the second acoustic resistor 25 at an inlet of the second air chamber 33, and the third acoustic resistor 35 at an inlet of the third air chamber 34. In other words, in the air chamber serving as the propagation path of the sound wave, a plurality of acoustic resistors, that is, the first acoustic resistor 15, the second acoustic resistor 25, and the third acoustic resistor 35 are arranged at intervals to each other in the direction of the propagation path of the sound wave. Acoustic resistance values of the plurality of acoustic resistors become higher as the propagation path of the sound wave goes away from the diaphragm. That is, relationship of:

$$r1<r2<r3$$

is established, where the acoustic resistance value of the first acoustic resistor 15 is r1, the acoustic resistance value of the second acoustic resistor 25 is r2, and the acoustic resistance value of the third acoustic resistor 35 is r3.

As described above, the air chamber serving as the propagation path of the sound wave is divided in a stepwise manner toward the propagating direction of the sound wave at the acoustic resistors 15, 25, and 35, and sectional areas become smaller in every stepwise division toward the propagating direction of the sound wave. That is, relationship of:

$$S1>S2>S3$$

is established, where the sectional area of the first air chamber 31 is S1, the sectional area of the second air chamber 33 is S2, and the sectional area of the third air chamber 34 is S3.

Here, the sectional areas S1, S2, and S3 of the air chambers 31, 33, and 34 are areas of when the air chambers 31, 33, and 34 are cut with a plane intersecting (for example, perpendicular to) a passing direction of the sound wave when the sound wave passes through the air chambers 31, 33, and 34.

Further, compliance of the air chamber serving as the propagation path of the sound wave, and divided in a stepwise manner toward the propagating direction of the sound wave becomes smaller in every stepwise division toward the propagating direction of the sound wave. That is, relationship of:

$$s1>s2>s3$$

is established, where the compliance of the first air chamber 31 is s1, the compliance of the second air chamber 33 is s2, and the compliance of the third air chamber 34 is s3.

A head case that covers the unit 1, the unit support 2, and the intermediate support 3 described above is joined to an upper end portion of the microphone case 6.

Figure 2:
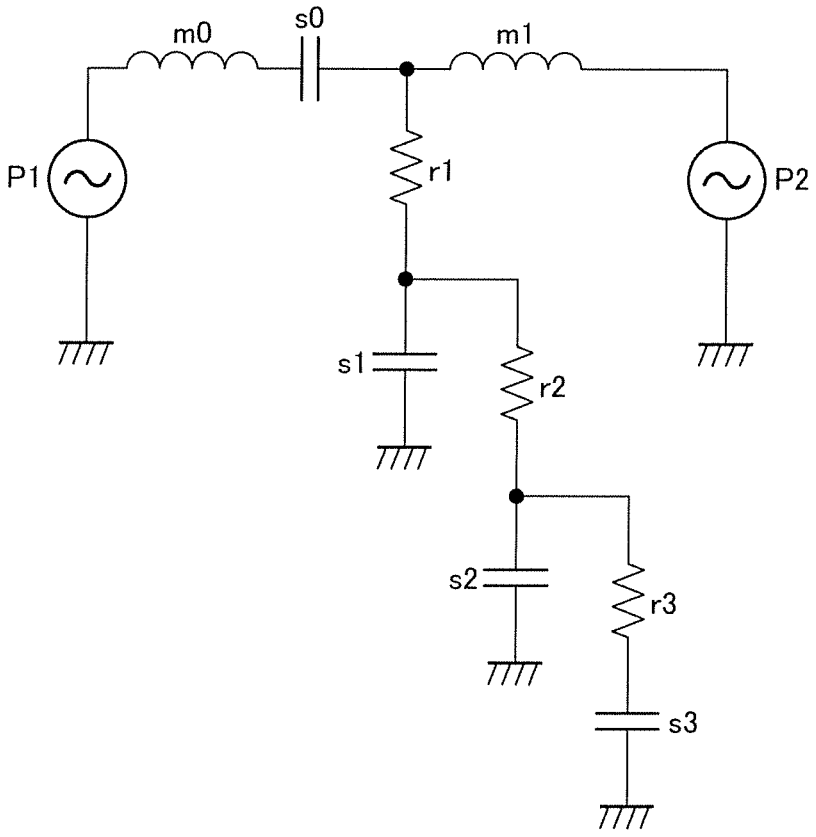
FIG. 2 is an acoustic equivalent circuit diagram of the dynamic microphone.

An acoustic equivalent circuit of the dynamic microphone 100 according to the above-described embodiment is illustrated in FIG. 2. The sound pressure provided to the front acoustic terminal is P1, the sound pressure provided to the rear acoustic terminal is P2, the mass of the diaphragm 14 is m0, the compliance of the diaphragm 14 is s0, and the mass of the air of the rear acoustic terminal is m1. Then, the acoustic resistance values of the first acoustic resistor 15, the second acoustic resistor 25, and the third acoustic resistor 35 are r1, r2, and r3, respectively. The compliance of the first air chamber 31 is s1, the compliance of the second air chamber 33 is s2, and the compliance of the third air chamber 34 is s3.

As illustrated in FIG. 2, the sound pressure P1, the mass m0 of the diaphragm 14, the compliance s0 of the diaphragm 14, the mass m1 of the air of the rear acoustic terminal, and the sound pressure P2 are connected in series. Series connection of the acoustic resistance value r1 and the compliance s1 is pulled out from a connection point between the compliance s0 and the mass m1. Series connection of the acoustic resistance value r2 and the compliance s2 is pulled out from a connection point between the acoustic resistance value r1 and the compliance s1, and this series connection is connected in parallel to the compliance s1. Series connection of the acoustic resistance value r3 and the compliance s3 is pulled out from a connection point between the acoustic resistance value r2 and the compliance s2, and this series connection is connected in parallel to the compliance s2.

Describing the equivalent circuit of FIG. 2 according to the configuration illustrated in FIG. 1, at first, the sound wave on the back side of the diaphragm 14 is guided to the first air chamber 31 having small acoustic impedance with little resistance. This portion corresponds to the series connection portion of the acoustic resistance value r1 and the compliance s1 of FIG. 2. The sound wave further goes through the second acoustic resistor 25 having a higher acoustic resistance value in some degree, and is folded back and guided to the second air chamber 33 having higher acoustic impedance in some degree. This portion corresponds to the series connection portion of the acoustic resistance value r2 and the compliance s2 of FIG. 2. The sound wave further goes through the second acoustic resistor 25 having a higher acoustic resistance value, and is folded back and guided to the third air chamber 34 having higher acoustic impedance. This portion corresponds to the series connection portion of the acoustic resistance value r3 and the compliance s3 of FIG. 2. The tip end of the third air chamber 34 is closed, and the sound wave reaches a terminus of the air chamber.

Focusing on the sectional areas of the air chambers of the propagation path of the sound wave, the sound wave is first guided to the first air chamber 31 having the largest sectional area S1, then to the second air chamber 33 having the sectional area S2 smaller than the sectional area S1, and to the third air chamber 34 having the smallest sectional area S3 in order. In this way, the sound wave is guided to the air chambers having the sectional areas that become smaller in sequence.

If the air chamber is closed near the back side of the diaphragm 14, the sound wave on the back side of the diaphragm 14 is immediately bounced back at the tip end of the air chamber, and the bounced sound wave acts on the diaphragm 14 and hinders vibration of the diaphragm 14. Especially, the vibration of the diaphragm 14 is more likely to be hindered as the frequency of the sound wave becomes lower.

In contrast, according to the dynamic microphone 100 of the embodiment of the present application, the air chamber serving as the propagation path of the sound wave, which exists on the back side of the diaphragm 14 of the unit 1, is formed by being folded back, so that the propagation path of the sound wave becomes long. Therefore, even about the sound wave at a low frequency, reflection of the sound wave from the air chamber, that is, the reactance is attenuated, and factors that hinder the vibration of the diaphragm 14 are reduced.

In the dynamic microphone 100 according to the embodiment, the plurality of acoustic resistors is arranged in the air chamber on the back side of the diaphragm 14 at intervals to each other in the direction of the propagation path of the sound wave. Then, the acoustic resistance values of the acoustic resistors are made higher as the propagation path of the sound wave goes away from the diaphragm. That is, the acoustic impedance is low near the diaphragm 14 and the acoustic impedance becomes higher as going away from the diaphragm 14. Therefore, at first, the sound wave is easily received by the air chamber, and is attenuated by the acoustic impedance as going away from the diaphragm, and a reactance component is decreased, and the factors that hinder the vibration of the diaphragm 14 are reduced.

The effect to reduce the factors that hinder the vibration of the diaphragm 14 can also be obtained by dividing the air chamber in a stepwise manner toward the propagating direction of the sound wave at the acoustic resistor, and the sectional area of the air chamber is made smaller in every stepwise division toward the propagating direction of the sound wave. Further, the effect can also be obtained by making the compliance of the air chamber smaller in every stepwise division toward the propagating direction of the sound wave.

The dynamic microphone according to the present invention has an advantage that a long air chamber can be easily secured for those with a transmitter that occupies a space, such as a wireless microphone. Note that the dynamic microphone according to the present invention can be applied to microphones other than the wireless microphone.

What is claimed is:

1. A dynamic microphone comprising:

a dynamic microphone unit;

an air chamber provided on a back side of a diaphragm of the dynamic microphone unit; and a plurality of acoustic resistors comprising at least a first acoustic resistor with an acoustic resistance value of r1 and a second acoustic resistor with an acoustic resistance value of r2, wherein the air chamber is configured to make a propagation path of a sound wave on the back side of the diaphragm long by reversing direction of the propagation path, the air chamber is configured such that the propagation path passes through the plurality of acoustic resistors, the plurality of acoustic resistors is arranged in the air chamber at spaced apart intervals to each other in a direction of the propagation path of a sound wave, the plurality of acoustic resistors are arranged such that sound waves on the propagation path of the sound wave on the back side of the diaphragm pass through the first acoustic resistor before passing through the second acoustic resistor, and acoustic resistance values of the plurality of acoustic resistors become higher as the propagation path of a sound wave goes away from the diaphragm such that $r1<r2$.

2. The dynamic microphone according to claim 1, wherein the air chamber is divided by the acoustic resistors in a stepwise manner toward a propagating direction of the sound wave, and sectional areas become smaller in every stepwise division as going toward the propagating direction of the sound wave.

3. The dynamic microphone according to claim 1, wherein the air chamber is divided by the acoustic resistors in a stepwise manner toward a propagating direction of the sound wave, and compliance becomes smaller in every stepwise division toward the propagating direction of the sound wave.

4. The dynamic microphone according to claim 1, wherein a tip end of the propagation path of a sound wave, of the air chamber, is closed.

5. The dynamic microphone according to claim 1, wherein the dynamic microphone unit is supported by a unit support, and an internal space of the unit support forms at least a part of the air chamber.

6. The dynamic microphone according to claim 5, wherein the internal space of the unit support forms a first air chamber, a second air chamber is formed between an outer periphery of the unit support and an inner periphery of a microphone case, the first air chamber and the second air chamber communicate with each other by a communication path, and the propagation path of a sound wave is folded back at the communication path.

7. The dynamic microphone according to claim 6, wherein both end portions of the unit support in the propagating direction of the sound wave are joined to the microphone case through a suspension, and the suspension positioned in the propagation path of a sound wave from the first air chamber to the second air chamber has an opening for propagating the sound wave.

8. The dynamic microphone according to claim 6, wherein an intermediate support provided at intervals from both the unit support and the microphone case is included between the unit support and the microphone case, a space between the unit support and the intermediate support forms the second air chamber, and a space between the intermediate support and the microphone case forms a third air chamber.

9. The dynamic microphone according to claim 8, wherein the intermediate support includes an opening that allows the second air chamber and the third air chamber to be folded back and communicate with each other.

10. The dynamic microphone according to claim 8, wherein the sound wave passes from the back side of the diaphragm to away from the diaphragm in the first air chamber, passes in the direction approaching the diaphragm in the second air chamber, and passes from the back side of the diaphragm to away from the diaphragm in the third air chamber.

* * * * *